US007770991B2

(12) United States Patent
Reinten et al.

(10) Patent No.: US 7,770,991 B2
(45) Date of Patent: Aug. 10, 2010

(54) METHOD OF CONTROLLING THE PRINT QUALITY FOR AN INKJET PRINTER AND A PRINTER WHICH FUNCTIONS TO PERFORM THIS METHOD

(75) Inventors: Hans Reinten, Velden (NL); Thomas P. Huijgen, Geldrop (NL); Hubertus M. J. M. Boesten, Melick (NL)

(73) Assignee: Océ-Technologies B.V., Venlo (NL)

( * ) Notice: Subject to any disclaimer, the term of this patent is extended or adjusted under 35 U.S.C. 154(b) by 183 days.

(21) Appl. No.: 11/345,401

(22) Filed: Feb. 2, 2006

(65) Prior Publication Data

US 2006/0170719 A1 Aug. 3, 2006

(30) Foreign Application Priority Data

Feb. 3, 2005 (NL) ..... 1028177

(51) Int. Cl.
*B41J 29/38* (2006.01)
*B41J 2/045* (2006.01)

(52) U.S. Cl. ..... 347/11; 347/14; 347/68

(58) Field of Classification Search ..... 347/9, 347/11, 14, 55, 68
See application file for complete search history.

(56) References Cited

U.S. PATENT DOCUMENTS 4,466,005 A * 8/1984 Yoshimura ..... 347/9
4,498,088 A * 2/1985 Kanayama ..... 347/92
4,518,974 A 5/1985 Isayama
4,695,852 A 9/1987 Scardovi
5,500,657 A 3/1996 Yauchi et al.
2004/0227782 A1* 11/2004 Shinkawa et al. ..... 347/19

FOREIGN PATENT DOCUMENTS

EP 1 013 453 A3 2/2001

OTHER PUBLICATIONS

Patent Abstracts of Japan, deel 012, nr. 392 (M-755), Oct. 19, 1988 & JP 63-141750-A, Jun. 4, 1988.

* cited by examiner

*Primary Examiner*—Matthew Luu
*Assistant Examiner*—Jannelle M Lebron
(74) *Attorney, Agent, or Firm*—Birch, Stewart, Kolasch & Birch LLP

(57) ABSTRACT

A method and system for application in an inkjet printer containing a substantially closed ink duct in which ink is situated, said duct being operationally connected to an electromechanical transducer, the method including the steps of: actuating the transducer with a number of actuation pulses according to a predetermined actuation setting in order to eject ink drops from a duct nozzle, where a pressure wave is generated in the duct by an actuation pulse, this pressure wave causing a deformation of an electromechanical transducer which generates an electrical signal; analyzing the electrical signal; analyzing the signal for a plurality of different actuation settings, and based on which analysis, determining an actuation setting, on the one side of which setting the ejection of a drop is a stable process and on the other side of which setting, the ejection of a drop is an unstable process.

3 Claims, 3 Drawing Sheets

METHOD OF CONTROLLING THE PRINT QUALITY FOR AN INKJET PRINTER AND A PRINTER WHICH FUNCTIONS TO PERFORM THIS METHOD

CROSS-REFERENCE TO A RELATED APPLICATION

This application claims priority to Dutch Patent Application No. 1028177 filed on Feb. 3, 2005 in The Netherlands, the entire contents of which is hereby incorporated by reference in its entirety.

BACKGROUND OF THE INVENTION

The present invention relates to a method for controlling the print quality in an ink jet printer. The present invention also relates to an inkjet printer system which is adapted to embody the present method.

Inkjet printers comprising electro-mechanical transducers, particularly piezo-electric transducers, are sufficiently known from the prior art. In these printers, each ink duct (also referred to as ink chamber) is operationally connected to an electro-mechanical transducer. By actuating the transducer so that it deforms, a sudden volume change is achieved in the ink duct associated with this transducer. The resulting pressure wave that is produced in the duct, provided that it is strong enough, leads to a drop of ink being ejected from the nozzle of the duct. Once the pressure wave has become sufficiently small, the associated transducer may be re-actuated to eject another ink drop. By actuating the duct image-wise (or multiple ducts if the printhead comprises more than one ink duct), an image may be printed onto a receiving medium by the printhead. This image (which may be 1, 2 or 3-dimensional) is therefore built up of individual ink drops.

For it to be possible to deploy such a printer reliably, actuation settings (such as actuation frequency and amplitude and, for example, the actuation pulse form) are chosen such that they provide a predictable print quality. However, the process of searching for these actuation settings is time-consuming as it requires analyzing printed test images. From a practical point of view, this is only possible in a research or production environment. Realizing that the optimal settings may differ from printhead to printhead, and that they may change over time due to printhead use, generally useable settings are often chosen that are sub-optimal. Such sub-optimal settings provide an acceptable print quality for virtually all printheads and, furthermore, remain adequate for printing a desired image even when the printheads are changed. A disadvantage of this is that virtually no printhead is used optimally, which may lead to an intrinsically lower productivity, print quality and printhead durability.

SUMMARY OF THE INVENTION

The present invention eliminates the above problems by making use of the fact that the generated pressure wave leads to a deformation of the transducer which generates an electric signal. It is known from European patent application 1 013 453 that from an analysis of this signal, information may be obtained as to the state in the duct while an ink drop is being ejected. The application has recognized that, in this manner, information on the stability of the ejection process may also be obtained. Research has shown that there are actuation settings, such as settings with an extremely high actuation frequency, where the ejection process is so unstable that it cannot be used to print an image without print artifacts. Such instability manifests itself, for example, by a sudden occurrence of a large number of print errors after the printer has been operating well for several minutes. Research has also shown that, with an electro-mechanical type of inkjet printhead, there is a regime for the actuation setting, particularly the actuation frequency and amplitude as well as the actuation pulse form, where the ejection process is stable, as well as a regime where this process is unstable. Both regimes are separable from each other by an important actuation setting. The method according to the present invention comprises the fact that, for a number of different actuation settings, the signals generated by the transducer in response to its deformation by the pressure wave, is analyzed, and based on this analysis the actuation setting is determined. For example, for an increasing series of actuation frequencies, the ejection process is assessed to be stable or unstable at each test frequency. From this information, the critical actuation setting is derived, without an analysis of the printed images being required. In this manner, it is easy to determine for which actuation settings the printing process produces a predictable print quality (stable process) and for which settings the quality is not predictable (unstable process). Furthermore, it is easy to carry out a test of this kind for each printhead separately, and to repeat it, if required or desirable, over time. As such, the present invention comprises a method of determining the actuation settings where the ink drop ejection process is stable as well as where this process is unstable. This know-how may be applied in many different ways to optimize the printing process, depending on the desired objective. For example, it may be decided to temporarily print with over-critical actuation settings if this would lead to virtually no undesirable print artifacts during the printing of the image. If more certainty regarding the quality of the image is required, then actuation settings could be used that are associated with a stable drop formation process. This might lead to a slightly lower print speed, but there would be more certainty regarding the good quality of the image to be printed.

According to one embodiment of the present invention, the analysis takes place such that the presence of air bubbles in the ink duct is determined. Research has shown that the occurrence of air bubbles is an important indicator for producing an unstable drop formation process. Beyond a certain actuation setting, air bubbles will often occur in the duct within a few seconds after the drop ejection process has started. Such air bubbles are not intrinsically present in the ink fed to the duct, but may occur while ink drops are ejected from the duct. The occurrence of such air bubbles may, as known from the prior art, be easily determined by analysis of the electrical signal that is generated by the transducer in response to the pressure wave in the duct. Therefore, if disturbing air bubbles occur in the duct within a few seconds, at a certain actuation setting, then the drop ejection process is unstable. In a printhead containing a large number of ink ducts, it is often detected, in this case, that air bubbles occur also within a few seconds in a considerable number of ducts, for example, in an amount of more than 5%. This means that, for the printhead as a whole, the chosen actuation setting may lead to an unpredictable print quality.

The present invention also relates to a method of determining the actuation setting for an electromechanical transducer of an inkjet printer containing a substantially closed ink duct in which ink is situated, said duct being operationally connected to the transducer, which comprises determining an important actuation setting as indicated above, and choosing an actuation setting where the ejection process is stable. In this method, it is decided to choose the actuation setting, particularly the actuation frequency and amplitude for the transducer as well as the actuation pulse form, such that the ejection process, also referred to as the drop formation process, is stable. In this manner, it is virtually guaranteed that each ink drop is the result of a stable drop formation process so that print artifacts may be obviated as much as possible. Furthermore, this method allows actuation settings to be chosen in such a way that they are virtually (or fully) equal to the desired actuation settings. In this manner, a printhead may be used up to its physical limits insofar as a stable drop formation process is concerned. This has advantages since, close to the critical actuation settings, ink drops are usually ejected from the duct at very high speed. This is advantageous since the positioning of the drops on the receiving medium, such as a sheet of paper, may then occur with greater accuracy. The method according to the present invention may be repeated from time to time in a printer that is in operation, for example on a regular basis or on the occasion of servicing, etc., so that it may be determined from time to time whether it is desirable to change the actuation settings. The change in itself could serve as an indicator for wear of the printhead.

The present invention also relates to an inkjet printer containing a substantially closed ink duct in which ink is situated, said duct being operationally connected to an electromechanical transducer, and a controller which is equipped such that the inkjet printer may automatically carry out the method as indicated above. The printer according to the present invention thus comprises a controller which is programmed in such a manner that the method according to the description above may be carried out automatically, i.e. without the intervention of a printer operator. In this printer, initiation of the method may, however, be made subject to an action to be carried out by the operator, e.g. because the operator instructs the printer to carry out the method. It should be understood that the programming of the controller may occur using hardware and/or software. Furthermore, components of the controller may be distributed across (or even externally to) the printer.

According to one embodiment of the present printer, the controller is programmed such that the method is carried out at predetermined moments. In this manner, more certainty may be obtained regarding the print quality.

BRIEF DESCRIPTION OF THE DRAWINGS

The present invention will now be further explained with reference to the following drawings, wherein.

DETAILED DESCRIPTION OF THE INVENTION

Figure 1:
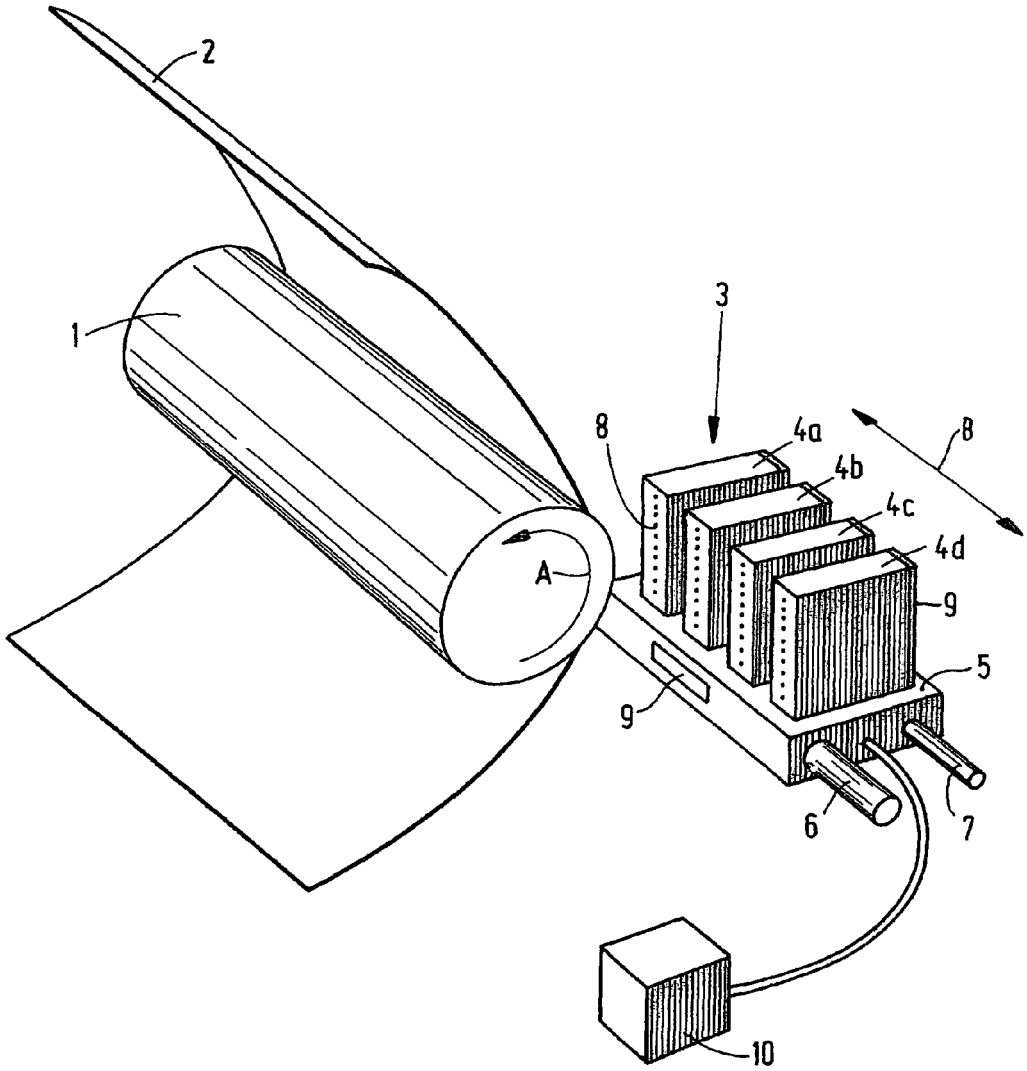
FIG. 1 is a diagram showing an inkjet printer.

FIG. 1 is a diagram showing an inkjet printer. According to this embodiment, the printer includes a roller 1 used to support a receiving medium 2, such as a sheet of paper or a transparency, which is moved along past the carriage 3. The carriage comprises a carrier 5 to which four printheads 4*a*, 4*b*, 4*c* and 4*d* have been fitted. Each printhead contains its own color, in this case cyan (C), magenta (M), yellow (Y) and black (K), respectively. The printheads are heated using heating elements 9, which have been fitted to the rear of each printhead 4 and to the carrier 5. The temperature of the printheads is maintained at the correct level by the application of central control unit 10 (controller).

The roller 1 may rotate around its own axis as indicated by arrow A. In this manner, the receiving medium may be moved in the sub-scanning direction (often referred to as the X direction) relative to the carrier 5, and therefore also relative to the printheads 4. The carriage 3 may be moved parallel to roller 1, in reciprocation, using suitable drive mechanisms (not shown) in a direction indicated by the double arrow B. To this end, the carrier 5 is moved across the guide rods 6 and 7. This direction is generally referred to as the main scanning direction or Y direction. In this manner, the receiving medium may be fully scanned by the printheads 4.

According to the embodiment as shown in FIG. 1, each printhead 4 includes a number of internal ink ducts (not shown), each with its own exit opening (nozzle) 8. The nozzles in this embodiment form one row per printhead, perpendicular to the axis of roller 1 (i.e. the row extends in the sub-scanning direction). According to a practical embodiment of an inkjet printer, the number of ink ducts per printhead will be many times greater and the nozzles will be arranged over two or more rows. Each ink duct includes a piezo-electric transducer (not shown) that may generate a pressure wave in the ink duct so that an ink drop is ejected from the nozzle of the associated duct in the direction of the receiving medium. The transducers may be actuated image-wise via an associated electrical drive circuit (not shown) by the application of the central control unit 10. In this manner, an image built up of ink drops may be formed on the receiving medium 2.

If a receiving medium is printed using such a printer where ink drops are ejected from ink ducts, this receiving medium, or a part thereof, is imaginarily split into fixed locations that form a regular field of pixel rows and pixel columns. According to one embodiment, the pixel rows are perpendicular to the pixel columns. The individual locations thus produced may each be provided with one or more ink drops. The number of locations per unit of length in the directions parallel to the pixel rows and pixel columns is called the resolution of the printed image, for example, indicated as 400×600 d.p.i. ("dots per inch"). By actuating a row of printhead nozzles of the inkjet printer image-wise when it is moved relative to the receiving medium as the carrier 5 moves, an image, or part thereof, built up of ink drops is formed on the receiving medium, or at least in a strip as wide as the length of the nozzle row.

Figure 2:
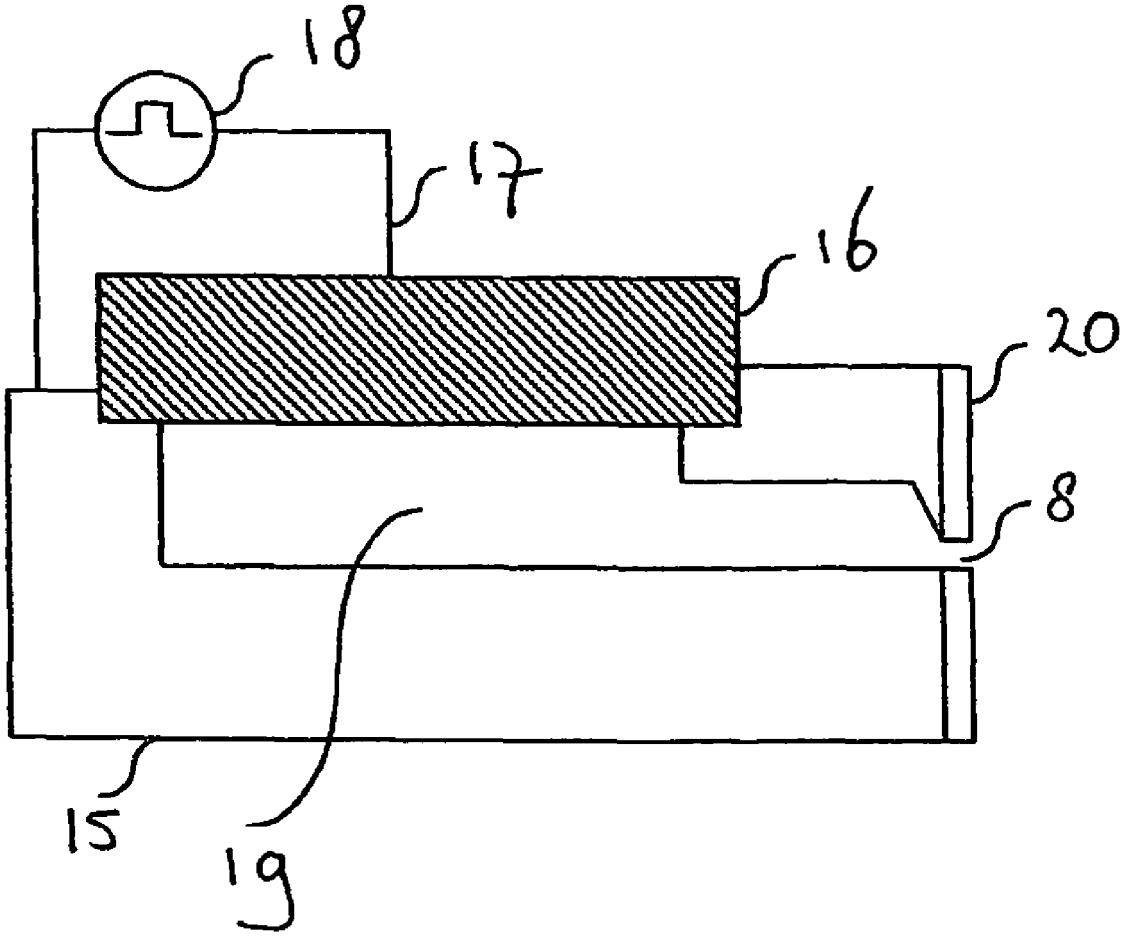
FIG. 2 is a diagram showing an ink duct assembly and its associated transducer.

FIG. 2 shows an ink duct 19 provided with a piezo-electric transducer 16. The ink duct 19 is formed by a groove in base plate 15 and is limited at the top mainly by piezo-electric transducer 16. Ink duct 19 terminates in exit opening 8, this opening being partially formed by a nozzle plate 20 in which a recess has been made at the level of the duct. When a pulse is applied across transducer 16 by a pulse generator 18 via actuation circuit 17, the transducer bends in the direction of the duct. This produces a sudden pressure rise in the duct, which, in turn, generates a pressure wave in the duct. If the pressure wave is strong enough, an ink drop is ejected from exit opening 8. After the expiration of the ink drop ejection process, the pressure wave, or a part thereof, is still present in the duct, after which the pressure wave will fully dampen over time. This pressure wave, in turn, results in a deformation of transducer 16, which then generates an electrical signal. This signal depends on all the parameters that influence the generation and the damping of the pressure wave. In this manner, as known from European patent application EP 1 013 453, it is possible by measuring this signal, to obtain information on these parameters, such as the presence of air bubbles or other undesirable obstructions in the duct. This information may then, in turn, be used to check and control the printing process.

Figure 3:
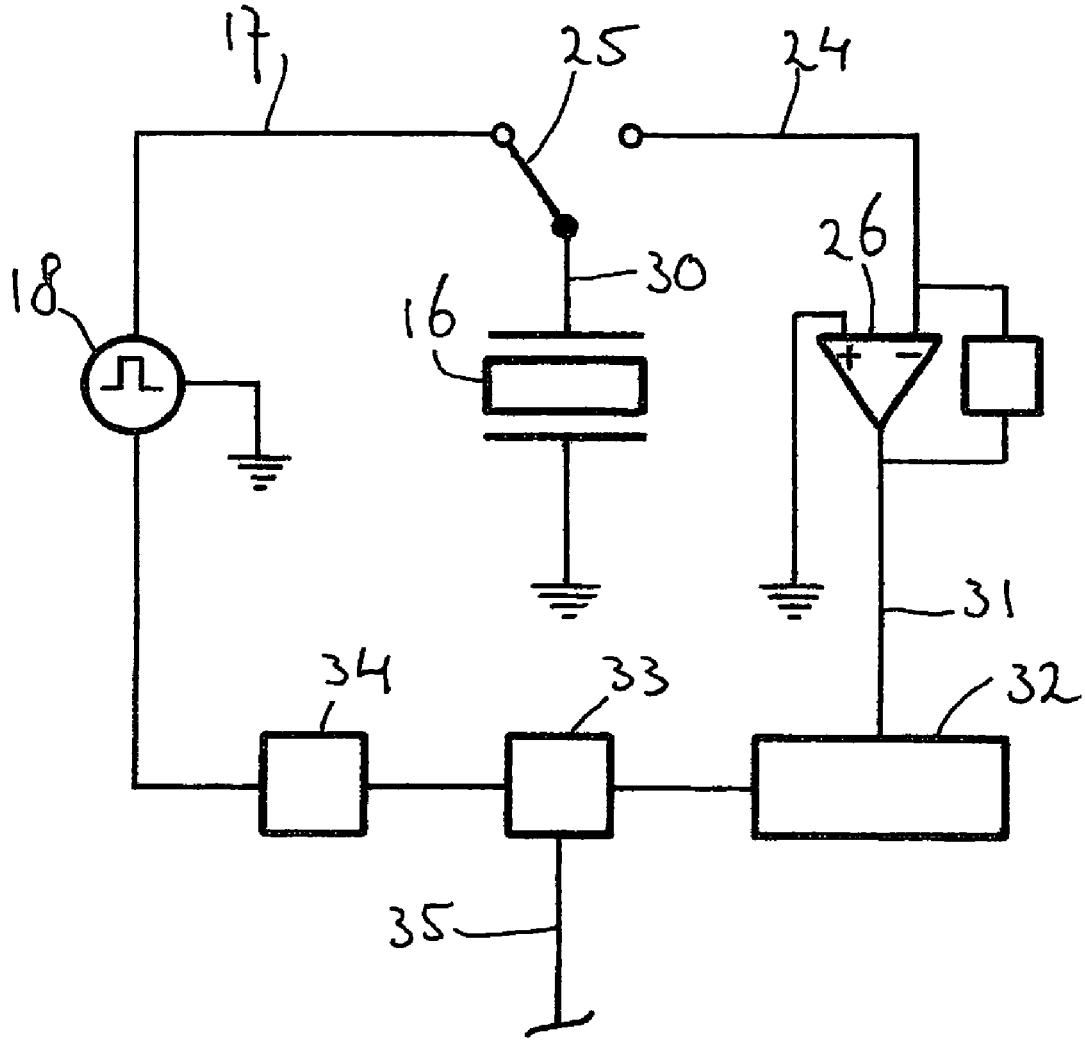
FIG. 3 is a block diagram showing a circuit that is suitable for measuring the state in the ink duct by the application of the transducer used as a sensor.

FIG. 3 is a block diagram showing the piezo-electric transducer 16, the actuation circuit (items 17, 25, 30, 16 and 18), the measuring circuit (items 16, 30, 25, 24, and 26) and control unit 33 according to one embodiment. The actuation circuit, comprising a pulse generator 18, and the measuring circuit, comprising an amplifier 26, are connected to transducer 16 via a common line 30. The circuits are opened and closed by two-way switch 25. Once a pulse has been applied across transducer 16 by pulse generator 18, item 16 is in turn deformed by the resulting pressure wave in the ink duct. This deformation is converted into an electric signal by transducer 16. After the expiration of the actual actuation, two-way switch 25 is converted so that the actuation circuit is opened and the measuring circuit is closed. The electric signal generated by the transducer is received by amplifier 26 via line 24. According to this embodiment, the resulting voltage is fed via line 31 to A/D converter 32, which offers the signal to control unit 33. This is where the analysis of the measured signal takes place. If necessary, a signal is sent to pulse generator 18 via D/A converter 34 so that a subsequent actuation pulse is modified to the current state of the duct. Control unit 33 is connected to the central control unit of the printer (not shown in this figure) via line 35, allowing information to be exchanged with the rest of the printer and/or the outside world.

EXAMPLE

This example shows the manner in which the method according to the present invention may be applied to a printer as described in connection with FIG. 1 (where the number of ink ducts per head is 120). To this end, the central control unit 10 comprises a programmable processor which arranges for the printer to carry out this method automatically, i.e. without the intervention of a printer operator.

In the present example, it is determined for a series of actuation frequencies, i.e. an ascending series of frequencies at which the transducers of the various ink ducts are actuated in order to eject ink drops, whether the ink drop formation process is stable. Here, use is made of the fact that, in the inkjet printer as described beneath FIG. 1, an unstable drop formation process manifests itself by the occurrence of air bubbles in the duct in question as a result of the actuation of the transducer. Other ways in which an unstable process may manifest itself may be, for example, an unpredictable drop in speed or an ink drop, now and again, failing to materialize altogether despite the actuation amplitude being strong enough to lead to the ejection of an ink drop. Depending on the type of inkjet printhead, an unstable process will manifest itself in one or more of the ways described above, or in a different manner not discussed.

In this example, each of the 120 ink ducts is, each time, actuated with an amplitude such that each actuation, in principle, leads to the ejection of an ink drop. The frequency at which the actuations succeed each other is increased in stages from 0 to 26,000 Hz. Each series of actuations aimed at drop ejection ends with a certain actuation which generates a pressure wave in the duct the deforming effect of which is measured on the transducer itself (by analysis of the electric signal generated by the transducer as described in connection with FIGS. 2 and 3). This makes it possible to easily determine whether air bubbles occur in the duct during the series of actuations. The last actuation of the series may be such that it also causes an ink drop to be ejected from the nozzle, but may also be such that it generates a pressure wave that fails to lead to drop ejection. At each frequency, it is determined in which ducts air bubbles occur within 5 seconds from the start of the actuation. The Table shows which percentage of the ink ducts of this printhead produces air bubbles within 5 seconds at a certain actuation frequency.

TABLE

| Frequency [Hz] (f) | Ducts containing air bubbles [%] |
|---|---|
| 0 | 0 |
| 1000 | 1 |
| 5000 | 0 |
| 10,000 | 0 |
| 14,000 | 1 |
| 18,000 | 1 |
| 22,000 | 5 |
| 26,000 | 40 |
| 30,000 | 100 |

Table 1. Air bubbles produced in ink ducts as a result of actuation at a frequency f.

It appears from the table that up to and including a frequency of 18,000 Hz, hardly any air bubbles occur in the ink ducts. However, at 22,000 Hz, it appears that air bubbles occur as quickly as within a few seconds in 5% of the ducts. This percentage increases quickly to 100% at a frequency of 30,000 Hz. In this example, it is determined that 18,000 Hz is the critical actuation frequency. At a lower frequency, the process of ejecting an ink drop is a stable process, in view of the fact that no air bubbles, or hardly any, occur as a result of the actuation. Above this frequency, however, actuation leads to the occurrence of air bubbles in a significant part of the ink ducts within a couple of seconds. The process of ejecting ink drops is apparently an unstable process at these higher frequencies. According to one embodiment of the present invention, the method is repeated, once the position of the critical actuation setting has been determined, using smaller steps around the critical value previously found. In this manner, the critical settings may be determined more accurately.

The method described above may also be repeated for other actuation settings, in combination with each other or not. It thus appears that the amplitude of each of the actuation pulses is a particularly important setting which has a critical value.

If the present method is utilized for a certain inkjet printhead, for example as soon as it has been produced, it is possible to choose the practical actuation settings for the particular head where the drop ejection process is stable. This means that the head may usually be used optimally as it is possible in most cases to achieve the most optimal print results at the critical settings. As a printhead may change over time, for example due to wear, but also because the position of the critical actuation settings depends on, for example, the environment conditions and the type of ink used in the head, it is advantageous to repeat the method. This may, for example, occur automatically during the initial process of the printhead each time the printer is started up. Another possibility is to carry out the method according to the present invention at regular intervals, or when certain conditions have suddenly changed, such as for example, when ink from a new batch is charged or the printer is relocated to another room, etc.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A method for controlling the print quality in an inkjet printer containing a substantially closed ink duct in which ink is situated, said duct being operationally connected to an electro-mechanical transducer, the method comprising:

(a) actuating the electro-mechanical transducer with an actuation pulse according to a predetermined actuation setting in order to eject an ink drop from the duct nozzle, whereby a pressure wave is generated in the duct by the actuated pulse, the pressure wave causing a deformation of the electro-mechanical transducer which, in turn, generates an electrical signal, (b) analyzing the electrical signal for determining the presence of air bubbles in the duct.

(c) repeating steps (a) and (b) for a plurality of actuation settings, (d) based on the analyses in steps (b) and (c), determining an actuation setting which separates the plurality of actuation settings into a first regime of actuation settings, for which the ejection of an ink drop is a stable process, and a second regime of actuation settings, for which the ejection of an ink drop is an unstable process, (e) selecting an actuation setting from the first regime, and (f) printing with the ink jet printer by actuating the electro-mechanical transducer with an actuation pulse according to the selected actuation setting.

2. The method of claim 1, wherein said method is carried out at predetermined moments.

3. An inkjet printer containing a substantially closed ink duct system operationally connected to an electro-mechanical transducer and a controller which comprises:

means for actuating the electro-mechanical transducer with a plurality of actuation pulses according to a predetermined actuation setting in order to eject ink drops from a duct nozzle of the ink duct system whereby an electrical signal is generated, and means for analyzing the signal for a plurality of different actuation settings for determining the presence of air bubbles in the duct, means for separating the plurality of actuation settings into a first regime of actuation settings for which the ejection of an ink drop is a stable process, and into a second regime of actuation settings for which the ejection of an ink drop is an unstable process, and means for selecting an actuation setting from the first regime, and means for printing with the ink jet printer by actuating the electro-mechanical transducer with an actuation pulse according to the selected actuation setting.

* * * * *